US007124819B2

(12) United States Patent
Ciglenec et al.

(10) Patent No.: US 7,124,819 B2
(45) Date of Patent: Oct. 24, 2006

(54) DOWNHOLE FLUID PUMPING APPARATUS AND METHOD

(75) Inventors: Reinhart Ciglenec, Katy, TX (US); Paal Kibsgaard, Houston, TX (US); Steven G. Villareal, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 213 days.

(21) Appl. No.: 10/707,246

(22) Filed: Dec. 1, 2003

(65) Prior Publication Data

US 2005/0115716 A1 Jun. 2, 2005

(51) Int. Cl.
*E21B 49/10* (2006.01)

(52) U.S. Cl. ..... 166/264; 166/105; 166/373; 166/107; 175/50; 175/59; 175/308; 73/152.19

(58) Field of Classification Search ..... 166/264, 166/105, 373, 107, 324, 332.3, 332.7, 334.2; 175/50, 59, 308; 73/152.24, 152.28, 152.19; 417/393, 403, 404
See application file for complete search history.

(56) References Cited

U.S. PATENT DOCUMENTS

| | | | | |
|---|---|---|---|---|
| 3,901,314 | A | 8/1975 | Nutter et al. | |
| 3,934,468 | A | 1/1976 | Brieger | |
| 4,507,957 | A | 4/1985 | Montgomery et al. | |
| 4,591,320 | A * | 5/1986 | Pope | 417/393 |
| 4,860,581 | A | 8/1989 | Zimmerman et al. | |
| 4,893,505 | A | 1/1990 | Marsden et al. | |
| 4,936,139 | A | 6/1990 | Zimmerman et al. | |
| 5,377,755 | A * | 1/1995 | Michaels et al. | 166/264 |
| 5,411,097 | A * | 5/1995 | Manke et al. | 166/324 |
| 5,587,525 | A | 12/1996 | Shwe et al. | |
| 5,622,223 | A | 4/1997 | Vasquez | |
| 5,791,414 | A | 8/1998 | Skinner et al. | |
| 6,192,984 | B1 | 2/2001 | Schultz | |
| 6,230,557 | B1 | 5/2001 | Ciglenec et al. | |
| 6,301,959 | B1 | 10/2001 | Hrametz et al. | |
| 6,343,650 | B1 | 2/2002 | Ringgenberg | |
| 6,516,898 | B1 * | 2/2003 | Krueger | 175/50 |
| 6,568,487 | B1 | 5/2003 | Meister et al. | |
| 6,585,045 | B1 | 7/2003 | Lee et al. | |
| 6,609,568 | B1 | 8/2003 | Krueger et al. | |
| 6,837,314 | B1 | 1/2005 | Krueger et al. | |

* cited by examiner

*Primary Examiner*—David Bagnell
*Assistant Examiner*—Matthew J. Smith
(74) *Attorney, Agent, or Firm*—Jennie Salazar; Matthias Abrell; Victor Segura

(57) ABSTRACT

A downhole fluid pump including a pump chamber, and a piston disposed in the pump chamber so that the piston will move in one selected from a charge stroke and a discharge stroke when the piston is exposed to a differential pressure. The downhole fluid pump may form part of a formation evaluation while drilling tool.

42 Claims, 6 Drawing Sheets

DOWNHOLE FLUID PUMPING APPARATUS AND METHOD

BACKGROUND OF INVENTION

Wells are generally drilled into the ground to recover natural deposits of oil and gas, as well as other desirable materials, that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the borehole wall.

It is often desirable to have information about the subsurface formations that are penetrated by a well. For example, one aspect of standard formation evaluation relates to the measurements of the formation pressure and formation permeability. These measurements are essential to predicting the production capacity and production lifetime of a subsurface formation.

One technique for measuring formation properties includes lowering a "wireline" tool into the well to measure formation properties. A wireline tool is a measurement tool that is suspended from a wire as it is lowered into a well so that is can measure formation properties at desired depths. A typical wireline tool may include a probe that may be pressed against the borehole wall to establish fluid communication with the formation. This type of wireline tool is often called a "formation tester." Using a probe, a formation tester can measure the pressure of the formation fluids, generate a pressure pulse to determine the formation permeability, and withdraw a sample of formation fluid for later analysis.

In order to use a wireline tool, the drill string must be removed from the well so that the tool can be lowered into the well. This is called a "trip" downhole. Because of the great expense and rig time required to "trip" the drill pipe, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

Another technique for measuring formation properties uses measurement tools and devices that are positioned near the drill bit in a drilling system. Measurements are made during the drilling process. A variety of downhole drilling tools, such as logging-while-drilling tools and measurement-while-drilling tools, commercially are available. "Logging-while-drilling"("LWD") is used to describe measuring formation properties during the drilling process. Real-time data, such as the formation pressure, allows the driller to make decisions about drilling mud weight and composition, as well as decisions about drilling rate and weight-on-bit, during the drilling process. It is noted that LWD and "measurement-while-drilling"("MWD") have different meanings to those having ordinary skill in the art. MWD typically refers to measuring the drill bit trajectory as well as borehole temperature and pressure, while LWD refers to measuring formation parameters, such as resistivity, porosity, permeability, and sonic velocity, among others. The distinction between LWD and MWD is not germane to the present invention, thus, this disclosure does not distinguish between the two terms.

Formation evaluation while drilling tools capable of performing various downhole formation testing typically include a small probe or pair of packers that can be extended from a drill collar to establish fluid communication between the formation and pressure sensors in the tool so that the formation fluid pressure may be measured. Some existing tools use a pump to actively draw a fluid sample out of the formation so that it may be stored in a sample chamber in the tool for later analysis. Such a pump is typically powered by a battery or by a generator in the drill string that is driven by the mud flow.

What is still needed, therefore, are techniques for downhole formation evaluation while drilling tool that are more reliable and efficient, yet able to conserve space in a downhole drill collar.

SUMMARY OF INVENTION

In some embodiments, the invention relates to a downhole fluid pump that includes a pump chamber and a piston disposed in the pump chamber so that the piston will move in one selected from a charge stroke and a discharge stroke when the piston is exposed to an internal pipe pressure.

In other embodiments, the invention relates to a downhole fluid pump that includes a pump chamber and a hydraulic chamber. The pump may also include a piston assembly having a first piston disposed in the pump chamber and defining a first section of the pump chamber, and a second section of the pump chamber, the piston assembly also having a second piston disposed in the hydraulic chamber and defining a first section of the hydraulic chamber and a second section of the hydraulic chamber. The first piston and the second piston may be connected by a connecting member, wherein the piston assembly is moveable with respect to the pump chamber and the hydraulic chamber. The pump may also include a valve in fluid communication with the pump chamber for selectively placing the pump chamber in fluid communication with a charge line or a discharge line, an internal pipe pressure isolation valve for selectively hydraulically coupling the hydraulic chamber to an internal pipe pressure, and an annular pressure isolation valve for selectively hydraulically coupling the hydraulic chamber to an annular pressure. In some embodiments the pump includes a spring disposed in one of the first section of the hydraulic chamber and the second section of the hydraulic chamber and positioned to exert a force on the piston assembly.

In other embodiments, the invention relates to a method of operating a fluid pump including operating the fluid pump in one selected from the group consisting of a charge stroke and a discharge stroke by applying an annular pressure to a piston, operating the fluid pump in the other of the charge stroke and the discharge stroke by applying an internal pipe pressure to the piston, and selectively repeating the applying the annular pressure to the piston and the applying the internal pipe pressure to the piston.

In some embodiments, the invention relates to a formation evaluation while drilling tool that includes a drill collar, a fluid inlet disposed in the drill collar, and a fluid pump in fluid communication with the fluid inlet. In some embodiments the fluid pump comprises a pump chamber and a first piston disposed in the pump chamber so that the piston will move in one selected from a charge stroke and a discharge stroke when the piston is exposed to an internal pipe pressure.

In some embodiments, the invention relates to a method of formation evaluation that includes establishing fluid communication between a fluid inlet in a formation evaluation while drilling tool and a formation, and drawing fluid into the tool by selectively repeating applying an annular pressure to a first side of a piston and applying an internal pipe pressure to the first side of the piston.

Other aspects and advantages of the invention will be apparent from the following description and the appended claims.

DETAILED DESCRIPTION

In one or more embodiments, the invention relates to a fluid pump that may be used in a downhole drilling environment. In some embodiments, the invention relates to a method for using a fluid pump. In one or more embodiments, the invention relates to a formation evaluation while drilling tool that includes a fluid pump. In some other embodiments, the invention relates to a method of formation evaluation while drilling. The invention will now be described with reference to the attached drawings.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string.

In this disclosure, "hydraulically coupled" is used to describe bodies that are connected in such a way that fluid pressure may be transmitted between and among the connected items. The term "in fluid communication" is used to describe bodies that are connected in such a way that fluid can flow between and among the connected items. It is noted that "hydraulically coupled" may include certain arrangements where fluid may not flow between the items, but the fluid pressure may nonetheless be transmitted. Thus, fluid communication is a subset of hydraulically coupled.

Figure 1:
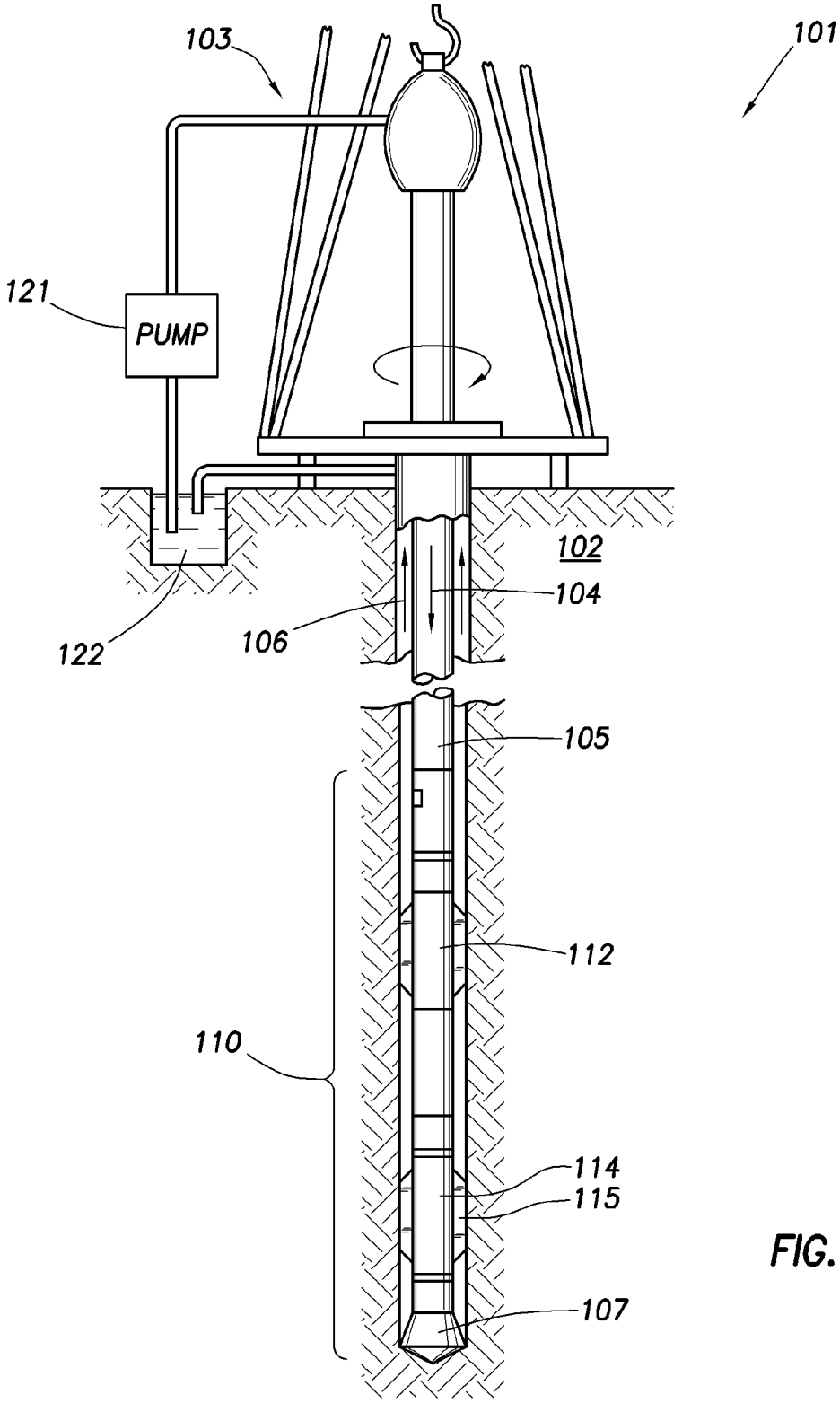
FIG. 1 shows one embodiment of a drilling system in which the present invention may be used.

FIG. 1 shows a drilling system 101 used to drill a well through subsurface formations. A drilling rig 103 at the surface is used to rotate a drill string 105 that includes a drill bit 107 at its lower end. As the drill bit 107 is being rotated, a "mud" pump 121 is used to pump drilling fluid, called "mud," down (shown at arrow 104) through the drill string 105 to the drill bit 107. The mud, which is used to cool and lubricate the drill bit, exits the drill string through ports (not shown) in the drill bit 107. The mud then carries drill cuttings away from the bottom of the borehole as it flows back to the surface (shown at arrow 106) through the annulus between the drill string 105 and the formation 102. At the surface, the return mud is filtered and conveyed back to the mud pit 122 for reuse.

The lower end of the drill string 105 includes a bottomhole assembly 110 ("BHA") that includes the drill bit 107, as well as a number of drill collars (e.g., 112, 114) that may include various instruments, such as LWD or MWD sensors and telemetry equipment. A formation evaluation while drilling tool may, for example, be disposed in a stabilizer 114. The stabilizer 114 includes blades 115 that are in contact with the borehole wall and reduce the "wobble" of the drill bit 107. "Wobble" is the tendency of the drill string, as it rotates, to deviate from the vertical axis of the wellbore and cause the drill bit to change direction. Advantageously, a stabilizer 114 is already in contact with the borehole wall, thus, requiring less extension of a probe to establish fluid communication with the formation fluids. Those having ordinary skill in the art will realize that a formation evaluation while drilling tool could be disposed in locations other than in a stabilizer without departing from the scope of the invention.

Figure 2:
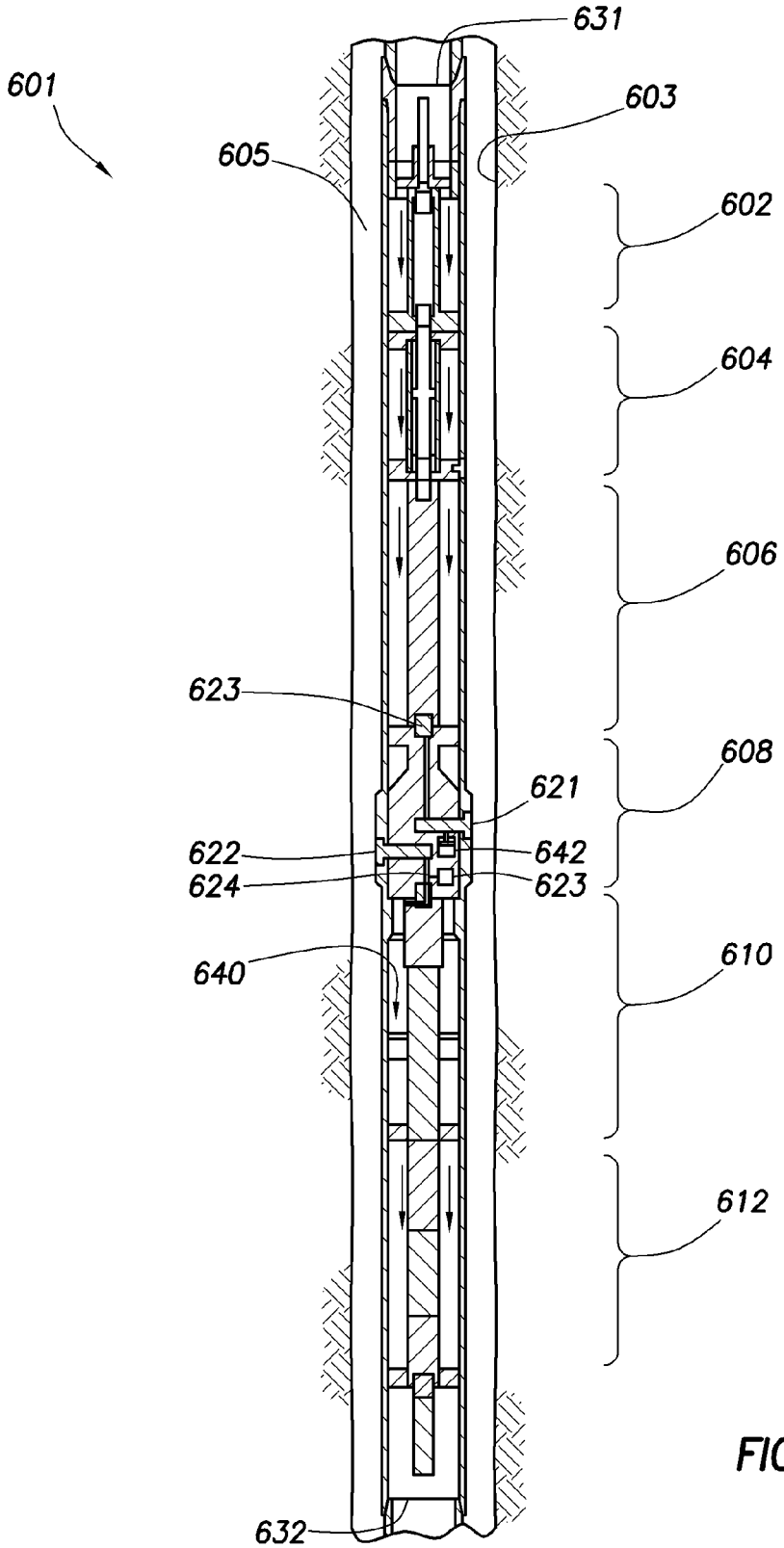
FIG. 2 shows a cross section of a drill string section that includes a formation evaluation while drilling tool, in accordance with one embodiment of the invention.

FIG. 2 shows a formation evaluation while drilling tool 601 in accordance with one or more embodiments of the invention. The tool 601 is disposed in a borehole 603. The annular area between the tool 601 and the borehole is called the "annulus" 605. The tool 601 includes an upper end 631 and a lower end 632 that are adapted to be connected in a drill string, such as the drill string 101 of FIG. 1, as is known in the art.

The tool 601 includes subsections, or modules, that house instruments for performing downhole operations. For example, subsection 602 is a battery module that includes a battery to power the electronics in the control system. Subsection 604 is a mandrel e-chassis that houses the electronic control systems and the telemetry equipment. Subsection 606 is a hydraulic module that controls the distribution of hydraulic power through the tool. Those having ordinary skill in the art will realize that other subsections or modules may be included in a formation evaluation while drilling tool, without departing from the scope of the invention. The tool may also be unitary, rather than having separate modules.

The formation evaluation while drilling tool 601 of FIG. 2 also includes an intake subsection 608, a pump subsection 610 and sample chamber subsection 612. The intake subsection 608 is located near the center of the tool 601. The intake subsection 608, as shown, includes probes 621, 622. These probes may extend to contact the sidewall of a borehole and establish fluid communication with a formation. Other devices, such as dual packers or packer and probe combinations may be used, as will be described later with reference to FIGS. 6A and 6B.

One or more of the probes may be selectively activated for performing formation evaluation, such as sampling and pressure testing. As shown in FIG. 2, the probe 622 is in fluid communication with a flow line 624 that enables formation fluid to flow from the formation into the tool 601. The intake section will be described in more detail with reference to FIGS. 6A and 6B. Various sensors or other instruments may be operatively coupled to the flow line 624 for determining formation fluid properties.

The tool 601 includes a passage 640 that enables the downward flow of mud through the tool 601. Instruments are preferably positioned within the subsections such that the passage permits the mud to flow through the passage 640 in the tool 601. The arrangement and order of the subsections, or modules, in the tool 601 may be modified depending on the circumstances. The module arrangement is not intended to limit the invention.

Figure 3:
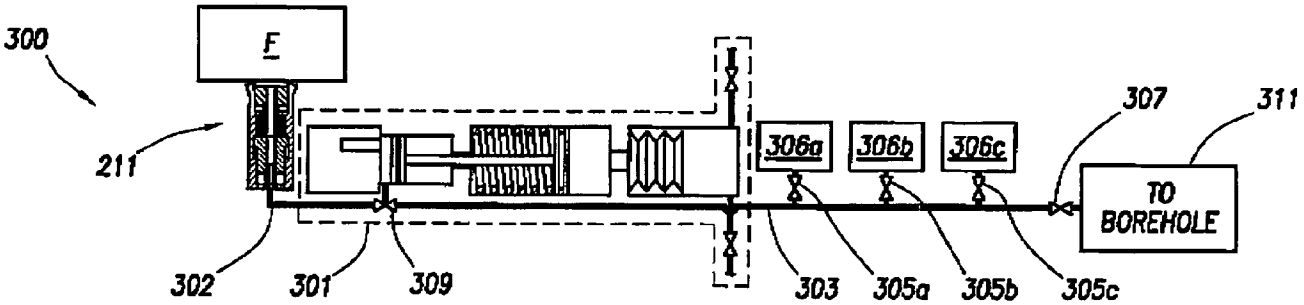
FIG. 3 shows a schematic of a formation evaluation while drilling tool in accordance with one embodiment of the invention.

FIG. 3 shows a schematic of a formation evaluation while drilling system 300 in accordance with one embodiment of the invention. The formation evaluation while drilling system 300 may form part of a formation evaluation while drilling tool, such as the formation evaluation while drilling tool 601 in FIG. 2 (i.e., the intake subsection 608, the pump subsection 610, and the sample chamber subsection 612). It is noted, that in this disclosure, a "formation evaluation while drilling tool" is used to refer to an entire tool, such as the one shown in FIG. 2. A "formation evaluation while drilling system" refers to a particular set of instruments and equipment in a tool that perform a specific type of formation evaluation. A formation evaluation while drilling tool may include more than one formation evaluation while drilling system.

The formation evaluation while drilling system 300 shown in FIG. 3 includes a probe 211, a pump 301, and sample chambers 306*a*, 306*b*, 306*c*. The pump 301 is in fluid communication with a fluid inlet (e.g., probe assembly 211 shown in FIG. 3) through a charge line 302, and the fluid inlet is in fluid communication with a formation F. The fluid pump 301 is also in fluid communication with a discharge line 303. In the embodiment shown, the discharge line 303 leads to the borehole discharge 311 and to a plurality of sample chambers 306*a*, 306*b*, 306*c* for storing formation fluid samples. In at least one embodiment, the charge line 302 and the discharge line 303 are essentially the same flow path but separated by a three-way valve 309. The three-way valve 309 may be positioned so that the pump 301 is in fluid communication with the charge line 302 and isolated from the discharge line 303, or the three-way valve 309 may be positioned so that the pump 301 is in fluid communication with the discharge line 303 and isolated from the charge line 302.

The discharge line 303 includes a dump valve 307 that can be selectively operated to put the pump 301 in fluid communication with the borehole discharge 311. For example, the dump valve 307 may lead to a borehole discharge 311 that comprises an exit port in the side of the tool. Each of the sample chambers 306*a*, 306*b*, 306*c* preferably includes a sample chamber isolation valve 305*a*, 305*b*, 305*c* that may be selectively operated to put the pump 301 in fluid communication with one or more of the sample chambers 306*a*, 306*b*, 306*c*.

Figure 4:
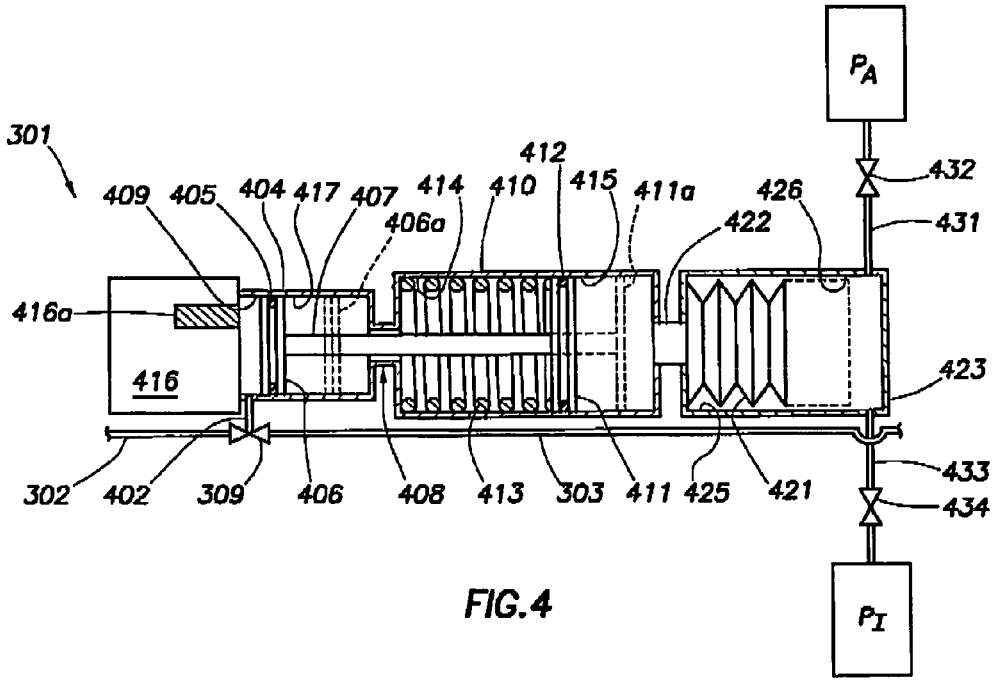
FIG. 4 shows a schematic of a pump in accordance with one embodiment of the invention.

FIG. 4 shows a detailed schematic of the pump 301 in the formation evaluation while drilling system 300 in FIG. 3. The pump 301 is powered by the pressure differential between the mud pressure in the drill string (called "internal pipe pressure," $P_I$) and the pressure in the annulus (called "annular pressure," $P_A$). Referring to FIG. 2, the internal pipe pressure $P_I$ is experienced in the passage 640 inside the tool 601, and the annular pressure $P_A$ is experienced in the annulus 605 between the tool 601 and the borehole wall 603. This pressure differential ($\Delta P = P_I - P_A$ is created because of the pressure drop associated with pumping the mud through the drill bit at the bottom of the drill string, or through other restrictions in the drill string. The differential pressure is typically 700–1200 pounds per square inch.

Referring again to FIG. 4, the pump 301 includes a pump chamber 404 and a hydraulic chamber 410. A piston assembly 408 includes a first piston 406 positioned in the pump chamber 404, a second piston 411 positioned in the hydraulic chamber, and a connecting member 407 connecting the first and second pistons 406, 411. The first piston 406 divides the pump chamber 404 into a first section and a second section. In the embodiment shown, the first section is a fluid pumping cavity 409 and the second section is a charge cavity 417. The second piston 411 of the piston assembly 408 divides the hydraulic chamber 410 into a first section and a second section, as well. In the embodiment shown, the first section of the hydraulic chamber 410 is a spring cavity 414 and the second section is a pressure cavity 415. Seals 405, 412 are preferably provided to prevent fluid from flowing between the spring cavity 414 and the pressure cavity 415. The connecting member 407 (e.g., a rod) connects the first piston 406 and the second piston 411 of the piston assembly 408. The piston assembly 408 reciprocates, or moves back and forth, by sliding within each of the chambers 404, 410. Dashed lines 406*a* show another possible position of the first piston 406 of the piston assembly 408, and dashed lines 411*a* show a corresponding position for the second piston 411 of the piston assembly 408.

Before the operation of the pump 301 is described, it is important to note that, in some embodiments, the formation evaluation while drilling system (300 in FIG. 3) is "pressure balanced." "Pressure balanced" means that all of the operative sections of the pump 301 are hydraulically coupled to the annular pressure $P_A$. For example, the spring cavity 414 of the hydraulic chamber 410 may be filled with clean hydraulic oil that is hydraulically coupled to the annular pressure $P_A$. The pressure cavity 415 of the hydraulic chamber 410, as will be described below, may be hydraulically coupled to either the annular pressure $P_A$ or the pipe internal pressure $P_I$. It is the pressure differential between the pipe internal pressure $P_I$ and the annular pressure $P_A$ that is used to operate the pump. Similarly, the charge cavity 417 of the pump section 404 may be filled with hydraulic oil that is hydraulically coupled to the annular pressure $P_A$.

In general, a reciprocating positive displacement pump, such as the one shown in FIG. 4, will have a "charge stroke" and a "discharge stroke." During the charge stroke, the pumping volume is increased so that fluid is drawn into the pump. During the discharge stroke, the pumping volume is decreased so that fluid is forced out of the pump. There are various arrangements of flow lines and valve positions that will enable a reciprocating positive displacement pump to pump fluid from one place to another using the charge and discharge strokes in a repeating and continuous manner.

The pump 301 shown in FIG. 4 has a charge stroke and a discharge stroke that are accomplished by moving the piston assembly 408 in different directions. When the piston moves in the charge stroke (i.e., to the right in FIG. 4), the volume of the fluid pumping cavity 409 of the pump chamber 404 will be increased, and fluid will be drawn from the flow line 402 into the fluid pumping cavity 409 of the pump chamber 404. By positioning the three-way valve 309 so that the pump chamber 404 is in fluid communication with the charge line 302 and the probe (e.g., 211 in FIG. 3), formation fluid will be drawn into the pump chamber 404 during the charge stroke.

It is noted that the embodiment shown includes a three-way valve 309, but a three-way valve is not required. For example, the junction could be controlled with a check valve and a two-way valve, or it could be controlled with two or more check valves. Additionally, a pump 301 could be devised where the charge line and the discharge line are not connected. In FIG. 4 the charge line and the discharge line essentially form part of the same section of pipe, separated by a valve. In some other embodiments, the discharge line may be separately connected to the pump 301. Those having ordinary skill in the art will be able to devise other arrangements of valves and charge and discharge lines without departing from the scope of the invention.

The piston assembly 408 is in a discharge stroke when it moves in a direction opposite to that of the charge stroke (i.e., to the left in FIG. 4). As the piston assembly 408 moves in the discharge stroke, the volume of the sample chamber 409 of the pump chamber 404 is reduced, and fluid will be pushed out of the pump chamber 404 and into the flow line 402. By positioning the three-way valve 309 so that the flow line 402 is isolated from the probe (e.g., 211 in FIG. 3) and in fluid communication with the discharge line 303, fluid may be forced from the pump 301 into the borehole or a sample chamber (e.g., 306*a*, 306*b*, 306*c* in FIG. 3).

In the embodiment shown in FIG. 4, a bellows chamber 423 is hydraulically coupled to the pressure cavity 415 of the hydraulic chamber 410. The bellows chamber 423 includes a bellows 421 that separates the bellows chamber 423 into a clean fluid cavity 425 and a mud cavity 426. As used herein, a "bellows" is a flexible and expansible vessel. The bellows 421 enables hydraulic chamber 410 to be hydraulically coupled to the annular pressure $P_A$ and to the internal pipe pressure $P_I$, without being in fluid communication with either. For example, annular pressure line 431 hydraulically couples the bellows chamber 423 to the annular pressure $P_A$, and the internal pipe pressure line 433 is hydraulically coupled to the internal pipe pressure $P_I$. The bellows chamber 423 may be selectively hydraulically coupled to either the annular pressure $P_A$ or the internal pipe pressure $P_I$ by operation of the annular pressure isolation valve 432 and the internal pipe pressure valve 434. For example, by opening the internal pipe pressure isolation valve 434 and closing the annular pressure isolation valve 434, the bellows chamber 423 will experience the internal pipe pressure $P_I$, and the bellows 421 will compress.

The bellows 421 is used so that the pump mechanisms will operate, as will be described, based on the pressure applied by the clean hydraulic oil in the clean fluid cavity 425. The pressure that the bellows 421 is exposed to may be transmitted to the second piston 411 through a connecting member 422 that puts the clean fluid cavity 425 in fluid communication with the pressure cavity 415 of the hydraulic chamber 410. This protects the pump mechanisms (e.g., the second piston 411 of the piston assembly 408) from the harsh and abrasive mud. Those having ordinary skill in the art will realize that the bellows 421 form part of one or more preferred embodiments that separate the mud from the moving piston, and that the bellows 421 are not required by all embodiments of the invention.

The charge stroke of the pump 301 is preferably driven by a spring 413 disposed in the spring cavity 414 of the hydraulic chamber 410. The spring 413 pushes on the second piston 411 of the piston assembly 408 in a direction of a charge stroke (i.e., to the right in FIG. 4). When the internal pipe pressure isolation valve 434 is closed and the annular pressure valve 432 is opened, the lower annular pressure $P_A$ is transmitted through the bellows 421 to the hydraulic chamber 410. In some embodiments, the spring 413 has a spring constant selected so that the spring 413 is able to displace the piston assembly 408 against the annular pressure $P_A$. Thus, in these embodiments, the spring 413 drives the charge stroke.

To operate the pump 301 in the discharge stroke, the annular pressure isolation valve 432 is closed, and the internal pipe pressure isolation valve 434 is opened. In this configuration, the bellows chamber 423 experiences the internal pipe pressure $P_I$. The internal pipe pressure $P_I$ forces the bellows 421 to compress, and hydraulic oil in the bellows 421 is forced into the pressure cavity 415 of the hydraulic chamber 410. By virtue of the flexible bellows 421, the hydraulic oil is at the internal pipe pressure $P_I$, and that pressure is exerted against the second piston 411 of the piston assembly 408. In some embodiments, the spring 413 has a spring constant that is selected so that the internal pipe pressure $P_I$ is enough to overcome the force of the spring 413 and compress it. In these embodiments, the internal pipe pressure $P_I$ drives the discharge stroke.

Selection of a spring 413 with an appropriate spring constant may be advantageous. By selecting a spring 413 with a desirable spring constant, the spring 413 will be compressed when exposed to internal pipe pressure $P_I$, and it will relax when exposed to the annular pressure $P_A$. As an example, referring to FIG. 4, when both the spring cavity 414 and the pressure cavity 415 of the hydraulic chamber 410 are exposed to annular pressure $P_A$, the pressure forces are balanced and the spring will drive the piston assembly 408 in a charge stroke, as described above. Similarly, when the pressure cavity 415 of the hydraulic chamber 410 is exposed to pipe internal pressure $P_I$, a properly selected spring will enable the increased pressure to compress the spring 413 and drive the piston assembly 408 in a discharge stroke.

It is noted that those having ordinary skill in the art will be able to devise other embodiments of the invention that do not depart from the scope of this invention. For example, an embodiment could be devised where the spring 413 is disposed in the pressure cavity 415, and the annular and internal pipe pressure may be selectively applied to the spring cavity 414 of the hydraulic chamber 410. Essentially, the functions of each section could be reversed. In such an embodiment, the spring would drive the discharge stroke, and the internal pipe pressure $P_I$ would drive the charge stroke. It is noted that the names of the cavities and chambers are not intended to be limiting. In FIG. 4, the names are descriptive of the function of the components in that embodiment.

Note that in some embodiments, it is preferable to maintain at least one of the pressure isolation valves 432, 434 closed at all times. Thus, one must be completely closed before the other is opened. This is because, in some embodiments, having both the annular pressure isolation valve 432 and the internal pipe pressure isolation valve 434 open at the same time will enable mud in the drill string to flow straight into the annulus. When this occurs, the pressure differential that drives the pump 301 will no longer exist. Additionally, the abrasive mud flow may "washout" the isolation valves 432, 434, so that they cannot be fully closed. Mud would be able to flow through isolation valves 432, 434, and drilling will be impossible. The drill string would have to be tripped for valve replacement before drilling may continue.

As shown in FIG. 4, the first piston 406 of the piston assembly 408 and the second piston 411 of the piston assembly 408 may have different effective surface areas. The ratio of the surface area of the two pistons 404, 411 may be selected, based on the pumping application, to create a mechanical advantage for the pump 301. For example, as shown in FIG. 4, the surface area of the second piston 411 of the piston is larger than the surface area of the first piston 406 of the piston assembly 408. Even with the same pressure acting on both pistons 406, 411 of the piston assembly 408, the force exerted on the second piston 411 will be greater because of the larger effective surface area. The term "effective surface area" is meant to indicate that portion of the piston to which a fluid pressure is applied. Also, varying shapes of a piston surface may cause the piston to have an effective surface area that is smaller than its actual surface area.

A common problem with sampling operations is that the mud in the borehole will often seep into the formation. Because of this mud filtrate "invasion," the first fluid that is withdrawn from the formation will typically be mud filtrate that has seeped into the formation. To correct for this, fluid is withdrawn from the formation and pumped into the borehole until the sample "cleans up" that is, until the fluid withdrawn is no longer mud filtrate, but the native formation fluid. Using various sensors to monitor how certain properties change during pumping may enable the determination of when the fluid has cleaned up. Once it is determined that the fluid has cleaned up, a sample may be taken by changing the valve settings and directing the fluid flow into a sample chamber (e.g., sample chamber 306*a* in FIG. 3).

The embodiment of a pump 301 shown in FIG. 4 includes a sensor package 416 located proximate the first section of the pump chamber 404. The sensor package 416 is used to detect certain properties of the fluid that is drawn into the pump chamber 404 on the charge stroke. For example, the sensor package may include a pressure sensor 416*a* that measures the pressure of the formation fluid. Other sensors may include fluid identification or fluid monitoring sensors that can distinguish between mud filtrate and the oil and gas in the formation. A fluid monitoring sensor enables the determination of when the pumped fluid has cleaned up. This may include a hydrogen sulfide detector, an optical sensor, or any other sensor that is known in the art. The sensors included in the pump are not intended to limit the invention and could be located in various positions throughout the formation evaluation while drilling tool in FIG. 2, such as adjacent the pump as shown in FIG. 4, adjacent the probe as shown in FIG. 2, or other locations.

In some embodiments, the formation evaluation while drilling system includes sensors that enables the system to determine fluid properties without having to take a sample. For example, a pump may include a density sensor, a resistivity sensor, or an optical sensor that enables the determination of certain fluid properties. The sensors included in the pump are not intended to limit the invention.

Another problem that may be encountered when taking samples is that the pressure of the formation fluid may drop below its "bubble point." The "bubble point"is the pressure below which dissolved gasses in the formation fluid will come out of the solution, and bubbles will form in the fluid. When the formation fluid pressure drops below its bubble point, several problems may result. First, the gas in the fluid will decrease the efficiency of the fluid pump. In extreme cases, it may become impossible to pump fluid and take a sample. Another potential problem is that once bubbles form in a fluid sample, the additional gas in the sample makes it impossible to identify the exact nature of the fluid in the formation. Also, the bubbles affect the pressure pulses created by pumping the fluid out of the formation. The effect makes it difficult to estimate the permeability of the formation itself. Thus, in some embodiments, it is desirable to maintain the fluid sample above its bubble point and in a single phase.

To protect against this problem, in some embodiments, a formation evaluation while drilling system (e.g., 300 in FIG. 3) includes a bubble point detector. Such a detector may be located near the pump chamber of the pump (e.g., in the sensor package 416 in FIG. 4) so that it is able to detect the formation fluid pressure at its lowest point. As an example, a formation evaluation while drilling system may include an ultrasonic emitter/detector that is capable of determining when bubbles form in the formation fluid as it is being pumped out of the formation. Other types of bubble point detectors may be used without departing from the scope of the invention.

In some cases, a downhole fluid pump may be used to pump a gas sample out of a formation. In those cases, the formation evaluation while drilling system may also includes an override that will enable the pump to operate even though there is gas in the sample.

Figure 5:
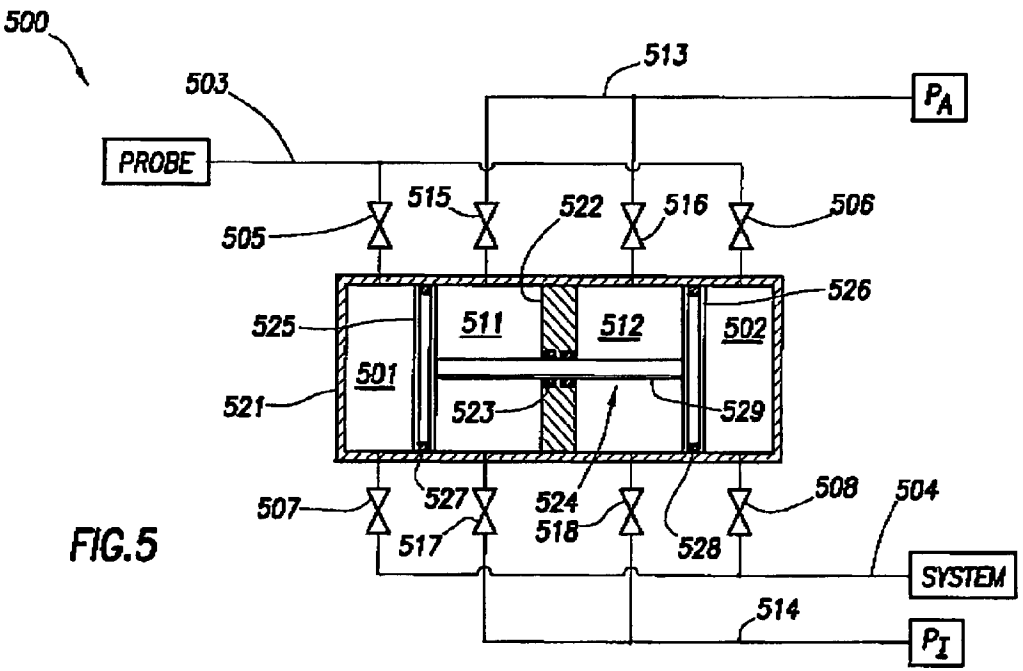
FIG. 5 shows a schematic of a pump in accordance with another embodiment of the invention.

FIG. 5 shows a pump 500 in accordance with another embodiment of the invention. The pump 500 may be used, for example, in the formation evaluation while drilling system shown in FIG. 3, or in various other downhole tools, such as the formation evaluation while drilling tool 601, shown in FIG. 2. The pump 500 includes a pump chamber 521 with a dividing member 522 that creates two pumping sections. A piston 524, having a first end 525 and a second end 526, spans the dividing member 522 to create a first pump section 501 and a first hydraulic section 511 on one side of the dividing member 522 and a second pump section 502 and a second hydraulic section 512 on the other side of the dividing member 522. A connecting member 529, e.g., a rod, connects the ends 525, 526 of the piston 524 and passes through the dividing member 522. Seals 523 seal around the connecting member 529 to prevent fluid from passing between the first hydraulic section 511 and the second hydraulic section 512, Seals 527 and 528 are also provided.

The pump 500 is connected to a charge line 503, which, in some embodiments, is in fluid communication with a probe. The charge line 503 is connected to the first pump section 501 through valve 505, and the charge line 503 is connected to the second pump section 502 through valve 506. In some embodiments, the valves 505, 506 are check valves that will only allow flow in one direction—from the charge line 503 to the pump sections 501, 502.

The pump 500 is also connected to a discharge line 504, which, in some embodiments, is in fluid communication with the borehole and one or more sample chambers (shown as "System" to indicate the remainder of the formation evaluation while drilling system). The discharge line 504 is connected to the first pump section 501 through valve 507, and the discharge line 504 is connected to the second pump section 502 through valve 508. In some embodiments, the valves 507, 508 are check valves that will only allow flow in one direction—from the pump sections 501, 502 to the discharge line 504.

The first hydraulic section 511 is connected to an annular pressure line 513 that is hydraulically coupled to the annular pressure $P_A$. An annular pressure isolation valve 515 can be selectively opened and closed to either expose the first hydraulic section 511 to the annular pressure $P_A$ or to isolate it from the annular pressure $P_A$. The first hydraulic section 511 is also connected to an internal pipe pressure line 514 that is hydraulically coupled to the internal pipe pressure $P_I$ in the drill string. An internal pipe pressure isolation valve 517 can be selectively opened and closed to either expose the first hydraulic section 511 to the internal pipe pressure $P_I$ or to isolate it from the internal pipe pressure $P_I$.

The second hydraulic section 512 is connected to the annular pressure line 513 that is hydraulically coupled to the annular pressure $P_A$. A second annular pressure isolation valve 516 can be selectively opened and closed to either expose the second hydraulic section 512 to the annular pressure $P_A$ or to isolate it from the annular pressure $P_A$ The second hydraulic section 512 is also connected to the internal pipe pressure line 514 that is hydraulically coupled to the internal pipe pressure $P_I$ in the drill string. A second internal pipe pressure isolation valve 518 can be selectively opened and closed to either expose the second hydraulic section 512 to the internal pipe pressure $P_I$ or to isolate it from the internal pipe pressure $P_I$.

By selectively operating the annular and internal pipe pressure isolation valves 515, 516, 517, 518, the piston 524 can be operated in a reciprocating manner to pump fluid from the probe to the borehole (not shown) or to a sample chamber (not shown). For example, by opening the first annular pressure isolation valve 515 and the second internal pipe pressure isolation valve 518, and by closing the first internal pipe pressure isolation valve 517 and the second annular pressure isolation valve 516, the first hydraulic section 511 will experience annular pressure $P_A$ and the second hydraulic section 512 will experience internal pipe pressure $P_I$. Because the internal pipe pressure $P_I$ is greater than the annular pressure $P_A$, the piston 524 will be moved in a direction so that the first hydraulic section 501 is in a charge stroke and the second hydraulic section 501 is in a discharge stroke (i.e., to the right in FIG. 5).

Conversely, by opening the second annular pressure isolation valve 516 and the first internal pipe pressure isolation valve 517, and by closing the second internal pipe pressure isolation valve 518 and the first annular pressure isolation valve 515, the first hydraulic section 511 will experience internal pipe pressure $P_I$ and the second hydraulic section 512 will experience annular pressure $P_A$. Because the internal pipe pressure $P_I$ is greater than the annular pressure $P_A$, the piston 524 will be moved in a direction so that the first hydraulic section 501 is in a discharge stroke and the second hydraulic section 501 is in a charge stroke (i.e., to the left in FIG. 5).

The pump 500 shown in FIG. 5 is a "double-acting" pump. "Double-acting" is used to mean that two actions may occur at the same time. For example, when the piston 524 moved in one direction, e.g. to the right in FIG. 5, the first pump section 501 will undergo a charge stroke, and, at the same time, the second pump section 502 will undergo a discharge stroke. When the piston 524 reverses direction, the first pump section 501 will undergo a discharge stroke, and the second pump section 502 will undergo a charge stroke.

Again, in some embodiments, it is advantageous to ensure that only one of the annular pressure isolation valve and the internal pipe pressure isolation valve for a hydraulic section (e.g., annular isolation valve 515 and internal pipe pressure isolation valve 517 for first hydraulic section 511) is open at any one time. This will prevent the mud from freely passing from the inside of the drill string to the annulus, thereby defeating the pressure differential used to operate the pump 500.

In some embodiments, the valves 505, 506, 507, 508 that connect the pump sections 501, 502 to the charge line 503 and the discharge line 504 are check valves that allow flow in only one direction. In these embodiments, operation of these valves is not required. In other embodiments, it may be advantageous to use valves that must be selectively operated. Those having ordinary skill in the art will realize that the discharge valves 507, 508 must be opened for the discharge stroke of their respective pump sections 501, 502, and the charge valves 505, 506 must be opened for the charge stroke of their respective pump sections 501, 502. Those having ordinary skill in the art will also realize that only one of the charge and discharge valves for any pump section (e.g., valves 505 and 507 on first pump section 501) should be open at any one time. The type of valves used in a fluid pump are not intended to limit the invention.

Alternate configurations of a pump and a formation evaluation while drilling system may be devised. For example, the bellows 421 and the bellows chamber 423 in FIG. 4 could be combined in various configurations with the embodiments of a pump shown in FIG. 5. Further, the embodiment shown in FIG. 5 may be configured with a spring so that only one hydraulic section is required for operation of the pump. In such an embodiment, it may be advantageous to use a surface area ratio between the ends of the piston. Those having ordinary skill in the art will be able to devise various other embodiments of a pump and formation evaluation while drilling system that do not depart from the scope of the invention.

FIGS. 4 and 5 show pumps that may be used in a variety of downhole tools. While the tool described with respect to these figures is a formation evaluation while drilling tool having differential pressure generated by the difference in annular pressure in the wellbore and internal pressure created by mud flow in the drill string, the pressure differential may also be generated by other means. For example, a pressure differential may be generated between annular pressure in the wellbore and internal pressure stored or contained within a tool, such as a wireline, coiled tubing, logging, or other downhole tool.

Figure 6A:
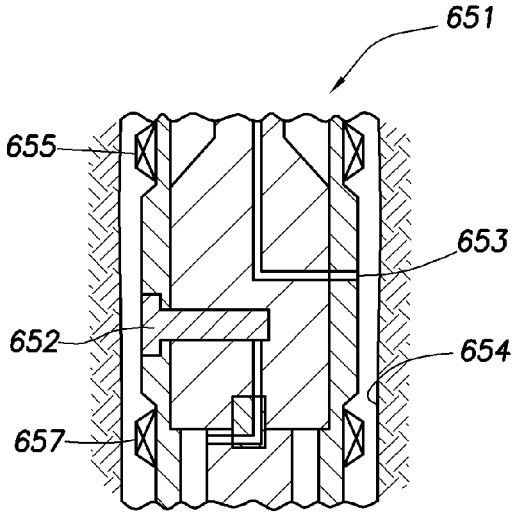
FIG. 6A shows a cross section of a probe module that includes a probe, an inlet, and packers, in accordance with one embodiment of the invention.
Figure 6B:
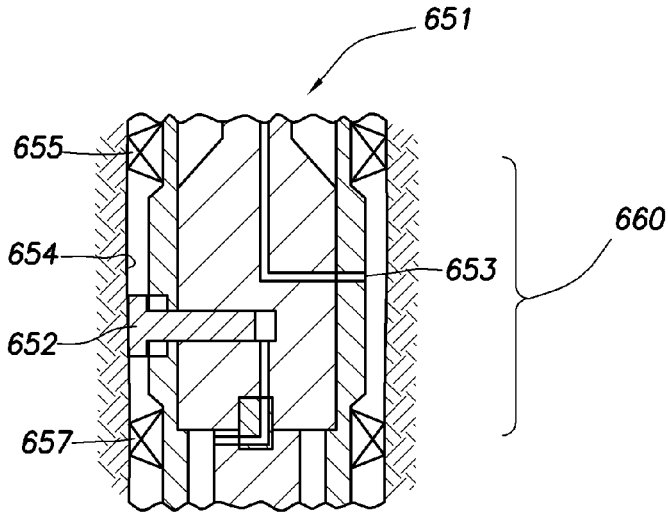
FIG. 6B shows a cross section of a probe module that includes a probe, an inlet, and packers, in accordance with one embodiment of the invention.

FIGS. 6A and 6B show intake subsections that may be used with certain embodiments of the invention. FIG. 6A shows a cross section of a portion of an intake section 651 provided with both a probe 652 and a simple fluid inlet 653. The intake subsection also includes an upper packer 655 and a lower packer 657 that "straddle" the fluid inlet 653. Such packers are often referred to as "straddle packers." The packers 655, 657 are in a deflated position. The intake subsection 651 or module is located in a well bore so that it is adjacent to a borehole wall 654.

FIG. 6B shows a cross section of the intake subsection 651 with the packers 655, 657 inflated so that they contact the borehole wall 654. The packers 655, 657 isolate a zone of interest 660 in the formation. A fluid pump may be used to draw fluid into the simple fluid inlet 653. As the fluid in the borehole between the packers 655, 657 flows into the inlet 653, that fluid is replaced by fluid that is drawn out of the formation. Fluid may be pumped for a sufficient time interval so that the fluid that enters the inlet 653 is formation fluid that has been drawn out of the formation and into the isolated region of the borehole between the packers 655, 657.

FIG. 6B also shows a probe 652 extended into contact with the borehole wall 654. Although the probe is shown in a module 651 that includes packers 655, 657, a probe may, as described below with reference to FIG. 7, enable fluid communication with a formation without the use of packers 655, 657.

The intake subsection or module as depicted in FIGS. 2, 6A, and 6B are examples of probe and packer combinations that may be used with the invention. A variety of combinations of probes and packers may be used, without departing from the scope of the invention. In some embodiments, a downhole tool may include packers but not include an extendable probe.

Figure 7:
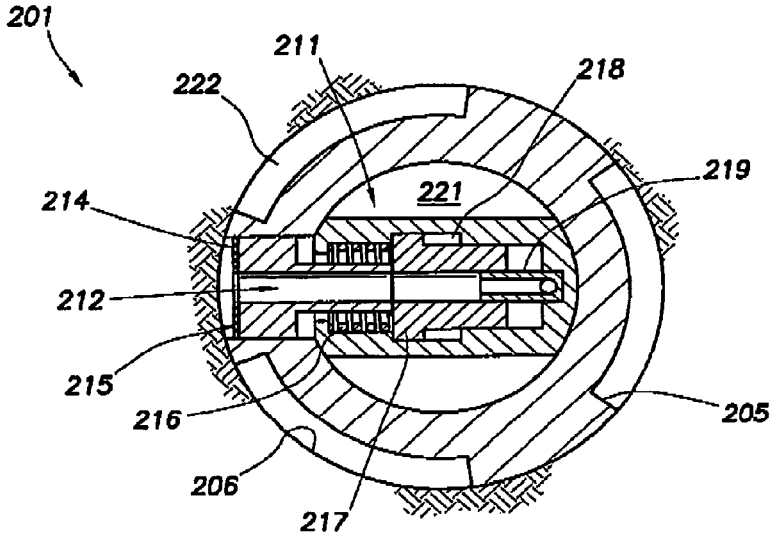
FIG. 7 shows a cross section of drill collar with a probe therein in accordance with one embodiment of the invention.

FIG. 7 shows a detailed cross section of a probe assembly 211 that may be used with a formation evaluation while drilling tool in accordance with certain embodiments of the invention. For example, the probe assembly 211 may be used in the formation evaluation while drilling tool shown in FIG. 2 and in the formation evaluation while drilling system in FIG. 3. FIG. 7 shows a cross section of one embodiment of a drill collar 201 that includes a probe assembly 211. This is an example of a probe that may be used in connection with the present invention. A similar probe having an additional piston and sensor device therein is described in co-pending U.S. application Ser. No. 10/248,782, assigned to the assignee of the present invention and hereby incorporated by reference.

The drill collar 201 shown includes blades 205 (or ribs) that stabilize the drill string, and the probe assembly 211 is positioned so that it will extend through one of the blades 205, which may be in contact with the borehole wall 206. While the probe is shown as being able to extend through a blade in the drill collar, it will be appreciated by one of ordinary skill in the art that a probe may be used in a drill collar that does not includes a blade.

One feature of drill collars and any associated tools is that they must allow mud flow both inside the drill string and in the annulus. To that end, the blades 205 are preferably spaced around the drill collar 201, in this case 120° apart, to provide an annular space 222 for the return mud flow. Additionally, the probe assembly 211 is disposed in the interior 221 of the drill collar 201, but is preferably positioned and sized so that there is enough space in the interior 221 of the drill collar 211 for the downward mud flow.

The probe assembly 211 includes a flow path 212 in fluid communication with a flow line 219 that enables the formation fluids to flow from the probe assembly 211 to additional sections of the drilling tool (not shown). In some embodiments, such as the one shown in FIG. 7, the probe 215 is pressed against the borehole wall 206 to isolate the flow path 212 from the borehole pressure. A packer 214 may also be provided to assist in forming a seal with the borehole wall 206.

During normal drilling operations, the probe 215 is in a retracted position so that the packer 214 and the flow path 212 are recessed inside the drill collar 201. When it is desired to perform formation evaluation, such as measuring the formation pressure or taking a sample of the formation fluid, the probe 215 may be moved to an extended position such that the packer 214 is in contact with the borehole wall 206. In some embodiments, the drill collar 201 rotates with the rest of the drill string. In these embodiments, drilling is typically stopped so that the probe may be extended to take a measurement or a sample. In other embodiments, a drill collar may be a counter rotating collar (not shown) where the blades counter rotate at the same rate as the drill string rotation so that the blades do not rotate with respect to the borehole. In these embodiments, the probe may be positioned into fluid communication with the borehole even when the drill string is being rotated. Any type of drill collar may be used with the invention. The type of drill collar used to house a probe is not intended to limit the invention.

In the embodiment shown, the probe 215 may be selectively moved between the extended and retracted position (FIG. 7 shows a retracted position). The spring 216 applies a force against block 217 such that the block is maintained in the retracted position in its normal or at rest position. The probe 215 is extended by applying fluid pressure to the probe block 217 that is sufficient to overcome the force of the spring 216 and move the probe block 217 into the extended position. A valve (not shown) may be opened so that an annular cavity 218 around the probe block 217 is hydraulically coupled to the mud pressure in the drill string (i.e., the internal pipe pressure $P_I$). The high pressure of the mud in the drill string fills the cavity and pushes the probe block 217 with enough force to overcome the force of the spring 216 and extend the probe 215 into contact with the formation.

The foregoing is only one example of a mechanism that may be used to move a probe between a retracted and an extended position. Those having skill in the art will be able to devise other mechanisms, without departing from the scope of the invention. For example, the spring 216 may be omitted and the probe block 217 may be moved to the retracted position using a motor or fluid pressure from inside the drill string.

FIG. 7 shows one type of fluid inlet, specifically a probe assembly 211, that may be used in connection with a formation evaluation while drilling tool in accordance with embodiments of the invention. Those having ordinary skill in the art will be able to devise other inlets that may be used with a formation evaluation while drilling tool without departing from the scope of the invention. For example, a formation evaluation while drilling may use a simple fluid inlet in conjunction with a pair of packers, as was described with reference to FIGS. 6A and 6B. The invention is not intended to be limited by the type of fluid inlet.

As shown in FIG. 2, a formation evaluation while drilling tool 601 may include a pretest piston 642 and one or more sensors 623 for measuring fluid properties. The pretest piston 642 is capable of performing conventional pretests known by those of skill in the art. The sensors 623 may include a pressure sensor capable of monitoring pressure fluctuations and pulses at the first probe 621 that are created by the pump-out system at second probe 623. This enables the estimation of the horizontal and vertical permeability of the formation. The sensor 623 may also include a fluid analyzer, a temperature gauge, as well as other measurement devices for determining fluid properties. Other sensors and pretest pistons may be disposed about the tool as desired. Additionally, appropriate valving and subflowlines may also be used to selectively direct fluid into the desired portions of the tool and to discharge fluid from the tool.

In some embodiments, the invention relates to methods for operating a pump. In some other embodiments, the invention relates to methods of formation evaluation. The description of the method includes many steps that are not required by the invention, but are included for illustrative purposes.

Figure 8A:
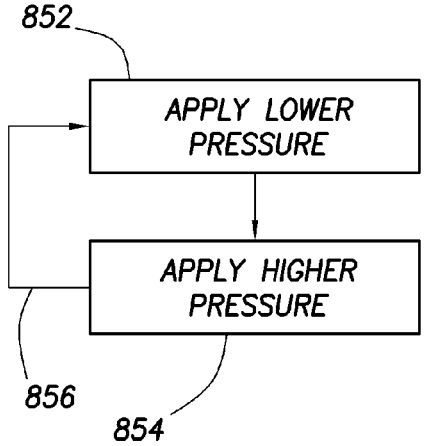
FIG. 8A shows a method in accordance with one embodiment of the invention.

FIG. 8A shows a method for operating a pump in accordance with one embodiment of the invention. The method first includes applying an lower pressure (step 852) to a first side of a piston in the pump. In some embodiments, the lower pressure is an annular pressure $P_A$. In some embodiments (i.e., in the pump 301 shown in FIG. 4), this will cause the piston to move in a charge stroke. In some other embodiments, applying the annular pressure to the first face of the piston will cause the piston to move in a discharge stroke. Next the method includes applying a higher pressure (step 854) to the first side of the piston in the pump. In some embodiments, the higher pressure is an internal pipe pressure $P_I$. In some embodiments, (i.e., in the pump 301 shown in FIG. 4), this will cause the piston to move in a discharge stroke. In some other embodiments, applying the annular pressure to the first face of the piston will cause the piston to move in a discharge stroke.

The method also includes (shown at arrow 856) selectively repeating applying the lower pressure to the first side of the pump and applying the higher pressure to the first side of the piston. This will cause the piston to alternate between the charge stroke and the discharge stroke. It is also noted that the starting point in some embodiments of the method may not be applying the lower pressure (i.e., step 852). In cases where the starting position of the pump is with the lower pressure applied to the first side of the piston in the pump, the higher pressure must be applied to begin the operation of the pump. Those having ordinary skill in the art will realize that beginning point in the repeating operation of the pump does not limit the invention.

Figure 8B:
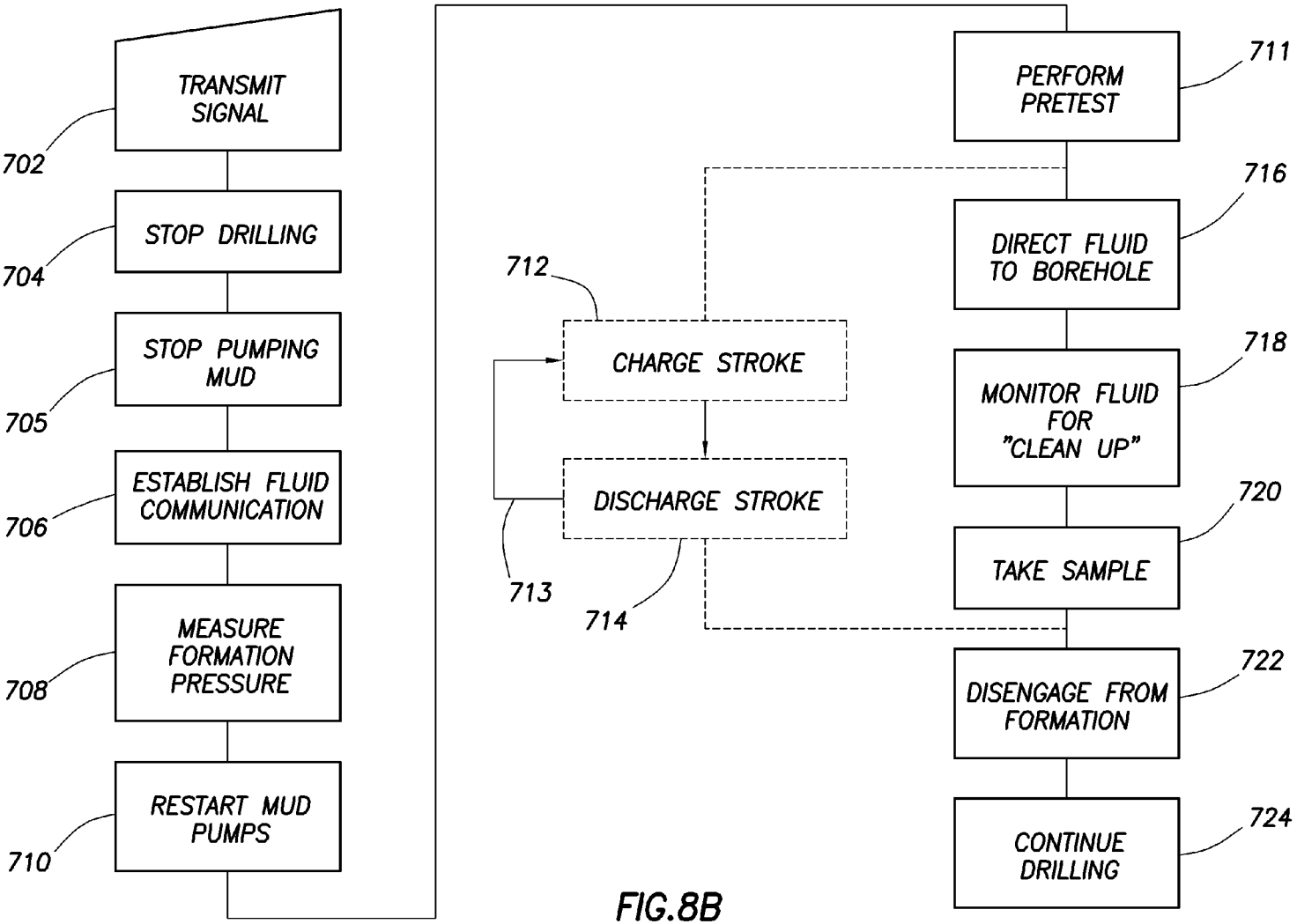
FIG. 8B shows another method in accordance with one embodiment of the invention.

Referring to FIG. 8B, the downhole drilling environment is a hostile environment, and communication with downhole devices can be challenging. It is often desirable to automate as much of the formation evaluation process as possible. In some embodiments, the first step 702 includes transmitting a start signal to a formation evaluation while drilling tool. In at least one embodiment, the signal is transmitted during drilling, and the signal instructs the formation evaluation while drilling tool to begin a testing or evaluation operation the next time the mud flow from the surface is stopped.

There are numerous methods for communicating with downhole devices, including various types of mud-pulse telemetry. These methods are known in the art and are not intended to limit the invention.

In some embodiments, the next step 704 includes stopping drilling and step 705 includes stopping the mud pumps so that the mud flow through the drill string is stopped. Stopping the rotation of the drill string will enable the formation evaluation while drilling tool to extend a probe or packers. Sensors may be included in the formation evaluation while drilling tool to determine when the mud flow has stopped. At that point, the system may begin a formation evaluation operation. In other embodiments, the formation evaluation while drilling tool may include other types of sensors that determine when drilling has stopped. For example, a sensor that detects when rotation has stopped may be used without departing from the scope of the invention. The type of sensor used is not intended to limit the invention.

It is noted that the step of stopping the drill string may not be required in embodiments of the invention where a formation evaluation while drilling tool is disposed in a counter-rotating drill collar. In these embodiments, the following steps may be performed while the drill string is still rotating.

Next, the method may include the step 706 of establishing fluid communication with the formation. In some embodiments, this is accomplished by extending a sample probe to be in fluid communication with the formation fluids. In some other embodiments, this is accomplished by inflating packers to be in contact with the borehole wall. In some embodiments, this step is initiated at a preselected time after the mud flow is stopped. The method may also include measuring the formation pressure using a pressure sensor disposed in the formation evaluation while drilling system, as shown at step 708. Following the measurement of the formation pressure, if performed, the method includes restarting the mud pumps at the surface so that mud is flowing through the drill string and back through the annulus, as shown at step 710. In some embodiments, the formation evaluation while drilling tool is preprogrammed to extend the probe (step 706) and measure the formation fluid pressure (step 708) once the mud flow is stopped. Those steps are performed in a preselected time interval, and the mud pumps are restarted after the preselected time interval.

In some embodiments, the method includes performing a pretest (step 711) using a fluid pump in the formation evaluation while drilling tool. The pretest may include operating the pump in one charge stroke (described below at step 712) and then measuring the pressure transient that is experienced at the probe or fluid inlet. This will enable an estimation of the formation pressure as well as an estimation of the formation permeability, as is known in the art.

Following step 711, the flow chart in FIG. 8B breaks into two paths. This is not intended to show a choice, but rather it is intended to show two independent paths that may be performed simultaneously. For example, the left side of the split path includes the steps 712, 714 of operating the formation evaluation while drilling system in a charge stroke and then in a discharge stroke, each of which will be explained in more detail below. The arrow 713 indicates that the charge and discharge strokes are repeated until the formation evaluation procedure is completed. These steps 712, 714 are shown in dashed lines because they may be performed concurrently with one or more of steps 716, 718, and 720, shown above. The steps 712 and 714, along with arrow 713, show a method of operating a fluid pump. These may be a subset of a method of formation evaluation.

In step 712, the charge stroke is initiated, for example, by applying the annular pressure $P_A$ to a hydraulic chamber in the pump. A spring in the pump will drive the charge stroke against the annular pressure $P_A$. At the beginning of the charge stroke, a pump chamber in the pump is put into fluid communication with the fluid in the formation so that formation fluid will be drawn into the pump during the charge stroke.

In step 714, the discharge stroke is initiated, for example, by applying the internal pipe pressure $P_I$ to a hydraulic chamber in the pump. The internal pipe pressure $P_I$ will drive the discharge stroke against the spring. At the beginning of the discharge stroke, the pump chamber is put into fluid communication with a discharge line in the formation evaluation while drilling system. The discharge line may selectively be put into fluid communication with a sample chamber or with the borehole.

The charge stroke (step 712) and the discharge stroke (step 714) are continuously repeated so that the effect is that formation fluid will be drawn out of the formation and into the pump and then pumped into the discharge line. This process may continue until it is no longer desired to pump fluid out of the formation.

It is noted that, in some embodiments, the charge stroke may be accomplished by applying the internal pipe pressure $P_I$, and the discharge stroke may be accomplished by applying the annular pressure $P_A$. The method for operating the pump will depend on the configuration of the pump. Also, it is noted that although the charge stroke (step 712) is shown first, it may be necessary to perform the discharge stroke (step 714) first. In those situations where the pump has an initial position that corresponds to the end of the charge stroke, the discharge stroke (step 714) must be performed first. Those having ordinary skill in the art will realize that order in which the charge stroke and discharge stroke are first performed is not intended to limit the invention.

While the pumping is going on (steps 712, 714) the discharge line may first be placed in fluid communication with a borehole discharge so that the pumped fluid is directed into the borehole (step 716). In some embodiments, this is accomplished by opening a dump valve located in the discharge line. As the pumping continues (steps 712, 714), the fluid is monitored with sensors to determine when the fluid cleans up, as shown at step 718. This may include using telemetry to transmit data to the surface so that the sensor data may be monitored at the surface. Alternatively, the sensor data may be monitored using a processor unit included in the downhole tool.

In some embodiments, once it is determined that fluid has cleaned up, the method next includes the step 720 of taking a sample. This may include opening a sample chamber isolation valve and closing the dump valve so that the clean formation fluid is pumped into a sample chamber. In some embodiments, a downlink telemetry signal is sent to the formation evaluation while drilling tool that instructs the system to open a sample chamber isolation valve and close the dump valve. In other embodiments, the downhole processor sends the instruction.

Once a sample is taken, the pumping (steps 712, 714) may be stopped. The probe may then be retracted or the packers may be deflated. This is shown at step 722 as disengaging fluid communication with the formation. In some embodiment, where drilling is stopped for the formation evaluation, the drilling may continue, as shown at step 724.

Some embodiments include a step (not shown) of estimating the depth of invasion in the formation. "Invasion" occurs when mud filtrate a liquid part of the mud seeps into the formation once the formation is drilled. The depth of invasion may be determined from the total volume of fluid that is pumped out of the formation before the fluid is cleaned up. This may be called total volume to clean up. This step not specifically shown in FIG. 8A because it may be performed at anytime after the fluid has cleaned up. In some embodiment, the invasion may be determined before the fluid has cleaned up, based on an estimation or prediction of when the fluid will be cleaned up. The total pumped volume to clean up may be determined by monitoring the movement of the piston. In some embodiments, the movement of the piston is measured by a sensor that monitors the position of the piston.

The method may also include monitoring the pressure pulses at another probe (e.g., probe 621 in FIG. 6A). The fluid pump that is coupled to the first probe creates pressure pulses in the formation as it pumps the formation fluid. These pressure pulses can be detected at the second probe. This will enable an estimation of the permeability of the formation.

Embodiments of the invention may present one or more of the following advantages. For example, a downhole pump that is powered by a differential pressure does not require a battery or an electrical generator to be included in the formation evaluation while drilling tool to power the pump. This may reduce the space the is required by the tool. A typical generator will use mud flow to generate electrical energy. The electrical energy will then be transmitted to a motor that will power the pump. Advantageously, a downhole pump powered by a pressure differential will use the mud pressure to power the pump, eliminating the need for a generator, electric power, and a motor.

Advantageously, a downhole pump that includes a bellows will prevent the abrasive mud from coming into contact with the pump. This will reduce the wear and tear on the pump from normal operation.

Advantageously, the piston in a downhole pump may include piston ends having different surface areas. This will create a ratio of pumping areas that will provide a mechanical advantage for the pump that will enable more efficient operation base on the pressure differential.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A downhole fluid pump for a downhole tool positioned in a wellbore penetrating a subterranean formation, comprising:

a pump chamber positionable in fluid communication with the subterranean formation;

a piston disposed in the pump chamber so that the piston will move in one selected from a charge stroke and a discharge stroke when the piston is exposed to a pressure differential between an internal pipe mud pressure and an annular pressure in the wellbore whereby fluid from the subterranean formation is drawn into the downhole tool.

2. The downhole fluid pump of claim 1, wherein the piston moves in the discharge stroke when exposed to a higher pressure.

3. The downhole fluid pump of claim 2, wherein the higher pressure is an internal pipe pressure.

4. The downhole fluid pump of claim 1, further comprising:

a second piston disposed in a second pump chamber; and a connecting rod coupled to the piston and the second piston.

5. A downhole fluid pump, comprising:

a pump chamber;

a hydraulic chamber;

a piston assembly having a first piston disposed in the pump chamber and defining a first section of the pump chamber and a second section of the pump chamber, the piston assembly also having a second piston disposed in the hydraulic chamber and defining a first section of the hydraulic chamber and a second section of the hydraulic chamber, the first piston and the second piston connected by a connecting member;

a valve in fluid communication with the pump chamber for selectively placing the pump chamber in fluid communication with at least one selected from a charge line and a discharge line;

an internal pipe pressure isolation valve for selectively hydraulically coupling the hydraulic chamber to an internal pipe pressure;

an annular pressure isolation valve for selectively hydraulically coupling the hydraulic chamber to an annular pressure; and a spring disposed in one of the first section of the hydraulic chamber and the second section of the hydraulic chamber and positioned to exert a force on the piston assembly, wherein the piston assembly is moveable with respect to the pump chamber and the hydraulic chamber.

6. The downhole fluid pump of claim 5, further comprising:

a bellows chamber; and a flexible bellows disposed in the bellows chamber and defining a first bellows chamber section and a second bellows chamber section, wherein the first bellows chamber section is in fluid communication with the second section of the hydraulic chamber, and the second bellows chamber section is in fluid communication with the annular pressure isolation valve and with the internal pipe pressure isolation valve.

7. The downhole pump of claim 5, wherein an effective surface area of the first piston is different from an effective surface area of the second piston.

8. The downhole pump of claim 7, wherein the effective surface area of the second piston is larger than the effective surface area of the first piston.

9. The downhole pump of claim 5, wherein the spring is disposed in the first section of the hydraulic chamber and configured to push the piston assembly in a charge direction.

10. The downhole pump of claim 5, further comprising at least one sensor.

11. The downhole fluid pump of claim 10, wherein the at least one sensor comprises a pressure sensor and a temperature sensor.

12. The downhole fluid pump of claim 10, wherein the at least one sensor comprises a fluid monitoring sensor.

13. The downhole fluid pump of claim 12, wherein the fluid monitoring sensor comprises an optical sensor.

14. The downhole fluid pump of claim 5, further comprising a bubble-point detector.

15. The downhole fluid pump of claim 14, wherein the bubble-point detector is an ultrasonic emitter/detector.

16. The downhole fluid pump of claim 14, wherein the bubble-point detector is disposed proximate the first section of the pump chamber.

17. A method of operating a fluid pump, comprising:

operating the fluid pump in one selected from the group consisting of a charge stroke and a discharge stroke by applying an annular pressure to a first side of a piston;

operating the fluid pump in the other of the charge stroke and the discharge stroke by applying an internal pipe mud pressure to the first side of the piston; and selectively repeating the applying the annular pressure to the first side of the piston and the applying the internal pipe mud pressure to the first side of the piston.

18. The method of claim 17, wherein the annular pressure is lower than the internal pipe mud pressure.

19. The method of claim 18, wherein the applying the annular pressure to the first side of the piston operates the fluid pump in the charge stroke, and the applying the internal pipe mud pressure to the first side of the piston operates the fluid pump in the discharge stroke.

20. The method of claim 18, further comprising:

directing pumped formation fluid from the fluid pump into a borehole annulus;

monitoring the pumped formation fluid to determine when the pumped formation fluid is substantially cleaned up; and once the pumped formation fluid has substantially cleaned up, directing the pumped formation fluid from the fluid pump into a sample chamber.

21. The method of claim 20, further comprising:

monitoring movement of the piston;

calculating a total pumped volume to clean up based on the movement of the piston; and determining a depth of invasion based on the total pumped volume to clean up.

22. The method of claim 18, further comprising measuring a formation fluid pressure.

23. The method of claim 18, wherein the fluid pump is coupled to a first probe that is in fluid communication with a formation and further comprising measuring pressure pulses at a second probe that is in fluid communication with the formation.

24. The method of claim 18, further comprising:

detecting a bubble in a formation fluid being pumped by the fluid pump; and slowing a pumping speed of the fluid pump.

25. A formation evaluation while drilling tool, comprising:

a drill collar;

a fluid inlet disposed in the drill collar; and a fluid pump in fluid communication with the fluid inlet, wherein the fluid pump comprises a pump chamber; and a first piston disposed in the pump chamber so that the piston will move in one selected from a charge stroke and a discharge stroke when the piston is exposed to an internal pipe mud pressure.

26. The formation evaluation while drilling tool of claim 25, wherein the first piston defines a first section and a second section of the pump chamber, the pump further comprising:

a hydraulic chamber;

a second piston disposed in the hydraulic chamber and defining a first section of the hydraulic chamber and a second section of the hydraulic chamber, the first piston and the second piston connected by a connecting member;

a valve in fluid communication with the pump chamber for selectively placing the pump chamber in fluid communication with at least one selected from a charge line and a discharge line;

an internal pipe pressure isolation valve for selectively hydraulically coupling the hydraulic chamber to an internal pipe mud pressure;

an annular pressure isolation valve for selectively hydraulically coupling the hydraulic chamber to an annular pressure; and a spring disposed in one of the first section of the hydraulic chamber and the second section of the hydraulic chamber and positioned to exert a force on the second piston, wherein the first piston is moveable with respect to the pump chamber and the second piston is moveable with respect to the hydraulic chamber.

27. The formation evaluation while drilling tool of claim 25, wherein the fluid pump further comprises:

a bellows chamber; and a flexible bellows disposed in the bellows chamber and defining a first bellows chamber section and a second bellows chamber section, wherein the first bellows chamber section is in fluid communication with the second section of the hydraulic chamber, and the second bellows chamber section is in fluid communication with the annular pressure isolation valve and with the internal pipe pressure isolation valve.

28. The formation evaluation while drilling tool of claim 25, wherein the fluid inlet comprises a probe that is extendable from the drill collar to be in fluid communication with a formation.

29. The formation evaluation while drilling tool of claim 25, further comprising a first packer disposed above the fluid inlet and a second packer disposed below the fluid inlet.

30. The formation evaluation while drilling tool of claim 25, further comprising an exit port and at least one sample chamber.

31. The formation evaluation while drilling tool of claim 25, further comprising at least one sensor.

32. The formation evaluation while drilling tool of claim 31, wherein the at least one sensor comprises one selected from the group consisting of a temperature sensor, a resistivity sensor, a pressure sensor, an optical sensor, and combinations thereof.

33. A method of formation evaluation, comprising:

establishing fluid communication between a fluid inlet in a formation evaluation tool and a formation; and drawing fluid into the tool by selectively repeating applying an annular pressure to a first side of a piston and applying an internal pipe pressure to the first side of the piston.

34. The method of claim 33, wherein the establishing fluid communication comprises inflating packers to isolate a zone of interest on a borehole wall.

35. The method of claim 33, wherein the establishing fluid communication comprises extending a probe to be in fluid communication with the formation.

36. The method of claim 33, further comprising:

directing a sample fluid from the fluid pump into a borehole annulus;

determining when the sample fluid has cleaned up; and directing the sample fluid into a sample chamber.

37. The method of claim 33, further comprising measuring a pressure transient at the fluid inlet.

38. The method of claim 33, further comprising measuring a pressure pulse at a second fluid inlet.

39. The method of claim 33, further comprising measuring at least one formation fluid property.

40. The method of claim 39, wherein the at least one formation fluid property is at least one selected from the group consisting of density, resistivity, and pressure.

41. The method of claim 33, further comprising:

transmitting a start signal to the fluid pump;

stopping a drilling process;

stopping a flow of mud through a drill string; and restarting the flow of mud through the drill string after a selected interval.

42. The method of claim 33, further comprising:

monitoring movement of the piston;

calculating a total pumped volume to clean up based on the movement of the piston; and determining a depth of invasion based on the total pumped volume to clean up.

* * * * *